US005139155A

United States Patent [19]

Laxson

[11] Patent Number: 5,139,155

[45] Date of Patent: Aug. 18, 1992

[54] HINGED PANEL STORAGE SYSTEM

[76] Inventor: Charles E. Laxson, 18061 Interlochen La., Alva, Fla. 33920

[21] Appl. No.: 587,215

[22] Filed: Sep. 24, 1990

[51] Int. Cl.[5] ..... A47F 5/12

[52] U.S. Cl. ..... 211/169; 211/88

[58] Field of Search ..... 211/169, 96, 168, 165, 211/88

[56] References Cited

U.S. PATENT DOCUMENTS

| | | | |
|---|---|---|---|
| 1,116,484 | 11/1914 | Ralph | 211/169 |
| 1,251,253 | 12/1917 | Lough | 211/169 |
| 1,256,465 | 2/1918 | Funke, Jr. | 211/169 |
| 1,572,832 | 2/1926 | Ayres et al. | 211/169 X |
| 1,688,255 | 10/1928 | Wasch | 211/169 X |
| 3,092,256 | 6/1963 | Vernik | 211/169 X |
| 3,181,706 | 5/1965 | Mandel | 211/169 X |
| 3,195,736 | 7/1965 | Bomar, Jr. | 211/169 X |
| 3,379,484 | 4/1968 | Kling | 211/169 X |
| 3,391,796 | 7/1968 | Cross | 211/169 |
| 3,412,868 | 11/1968 | Charter | 211/169 X |
| 3,514,883 | 6/1970 | Albright | 211/169 X |
| 3,759,396 | 9/1973 | Best et al. | 211/169 X |
| 3,777,896 | 12/1973 | Ehrlich | 211/169 X |
| 3,960,273 | 6/1976 | Weston | 211/165 X |
| 4,170,392 | 10/1979 | Spevak | 211/169 X |
| 4,285,556 | 8/1981 | Loeffel | 211/169 X |
| 4,286,832 | 9/1981 | Spevak | 211/169 X |
| 4,339,164 | 7/1982 | Spevak | 211/169 X |
| 4,678,086 | 7/1987 | Nervig et al. | 211/169 X |
| 4,898,281 | 2/1990 | Cherry | 211/169 X |
| 4,955,488 | 9/1990 | Nicoll | 211/88 |

FOREIGN PATENT DOCUMENTS

| | | | |
|---|---|---|---|
| 599649 | 6/1960 | Canada | 211/169 |

*Primary Examiner*—Carl D. Friedman
*Assistant Examiner*—Korie H. Chan
*Attorney, Agent, or Firm*—Richard C. Litman

[57] ABSTRACT

The present invention comprises a set of panels hinged along one side edge to rotate about a vertical axis. The panels' faces are adapted to store various items: the panel faces may include bins, perforated board to accept hooks, card racks, wire mesh, and so on. Any one panel may contain various surfaces or containers for storing various items; these are set at appropriate heights for easy use. The panels are set into channels running along the floor and ceiling, and rotate about fixed points on the channels. The panels are speced slightly apart to allow a user to look between the panels and thus to easily find the needed items.

5 Claims, 1 Drawing Sheet

HINGED PANEL STORAGE SYSTEM

FIELD OF THE INVENTION

The present invention relates to storage systems with hinged storage panels arranged to open as do the pages of a book. The system thus occupies a small space while allowing access to the panel faces where items are stored.

DESCRIPTION OF THE PRIOR ART

Roesler, in U.S. Pat. No. 341,693, shows racks hinged to a central support. The racks each comprise a solid lower beam and an upper beam with holes, in the manner of a test tube rack. The racks are intended for holding farm tools with long handles such as pitchforks.

Sonksen, in U.S. Pat. No. 2,923,417 discloses intersecting panels with perforations (used with bent-wire hangers which insert into the perforations to hand tools and the like upon the panels) where the panels may be split along a vertical line and the two sections hinged together, so that the outer section can be folded in out of the way.

Kling, in U.S. Pat. No. 3,379,484, shows a support panel hinged to the inside of a cabinet. On the surface of this support panel are a number of secondary perforated-board panel racks mounted side by side on hinges. Thus the support panel with its attached panel racks may be swung out of the cabinet, and then the secondary racks swung either way to allow access to the surfaces.

Green, in British patent 1,291,261, teaches a system of card holding racks. The racks are mounted in panels, so that cards may be inserted onto racks on either side of a flat rectangular panel. Each panel is then pivotally mounted to either a pole or a belt for access to the cards.

Schneider, in French patent 1,459,552, discloses a vertical hinged wire rack system.

Italian patent 539,387 shows hinged bookshelves.

None of the above inventions and patents, taken either singly or in combination, is seen to describe the instant invention as claimed.

Previous systems of hinged panels are not adapted to store a variety of items having various sizes and shapes. For example, in a certain enterprise it may be necessary to store cards or papers, bolts, large irregular objects, tools, and other things. Storage for dissimilar objects is required in many places, such as parts stores and workshops.

Storage systems disclosed in the prior art do not address this need. As a result, storage of various items requires various storage systems, or inefficient use of storage means that were designed for other items. These inefficient methods use a great deal of floor space. Since space in buildings is expensive, any way of reducing of the space needed for storing various types of items would be a benefit.

Storage adapted to various items should take into account the human aspect. One example is that items stored in bins should not be above eye level. Also, filing is more difficult if many kinds of things are stored. Thus, if only books, or only bolts, or only 3 by 5 cards are stored, a filing system can be easily set up; but if all sorts of things are mixed, it is more difficult to set up a simple filing system. The storage systems shown in the prior art have not addressed this problem.

Accordingly, one object of the present invention is a system of hinged panels adapted to store various types of items.

Another object of the present invention is hinged panels with various surfaces adapted to store various types of items.

A further object of the present invention is hinged panels with storage means adapted to the height of those means from the floor, for ease of use.

A final object of the present invention is a system of hinged panels spaced so as to allow visibility of items on the faces of the panels, thereby avoiding the need for complicated filing systems.

These and other objects of the present invention will become readily apparent upon further review of the following specification and drawings.

SUMMARY OF THE INVENTION

The present invention comprises a set of panels hinged along one side edge to rotate about a vertical axis. The panels' faces are adapted to store various items: the panel faces may include bins, perforated board to accept hooks, card racks, wire mesh, and so on. Any one panel may contain various surfaces or containers for storing various items; these are set at appropriate heights for easy use. The panels are set into channels running along the floor and ceiling, and rotate about fixed points on the channels. The panels are spaced slightly apart to allow a user to look between the panels and thus to easily find the needed items.

DETAILED DESCRIPTION OF THE PREFERRED EMBODIMENT

Figure 1:
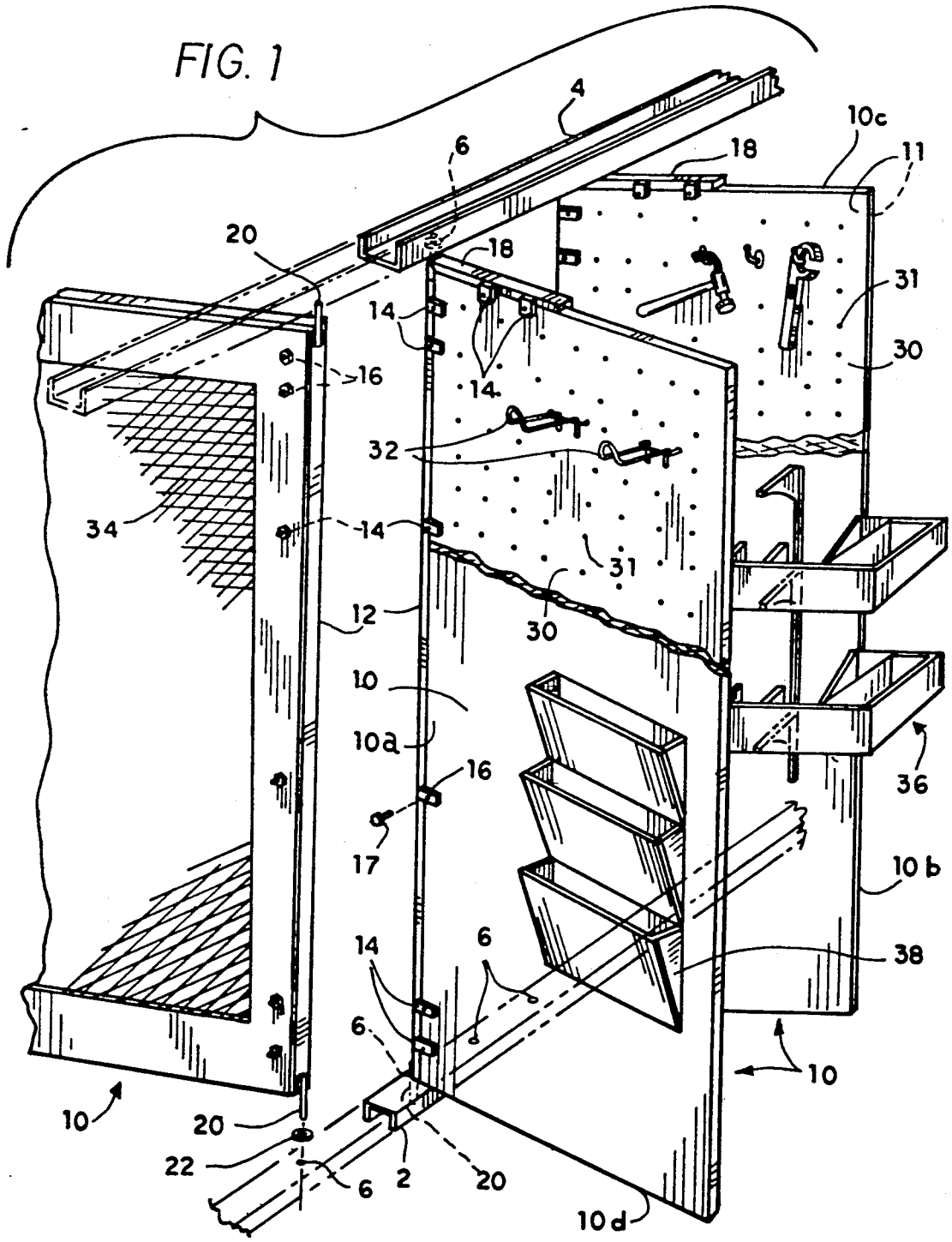
FIG. 1 is a perspective view of the present invention, showing panels with various storage surfaces, the floor and ceiling channels on which the panels rotate, and details of construction.

Referring to FIG. 1, a bottom channel 2 and a top channel 4 are fastened to the floor and ceiling, respectively, of a room. (The room is not shown.) These channels, which may be of ordinary 1 and ½ by 2 inch steel channel stock, are drilled at intervals with holes 6. These holes serve as pivot points and retainers for the panels 10. (The panels 10 swing relatively and open as do the pages of a book to allow access to items stored on their sides, or in containers on their sides. The panels 10 may be disposed on one or on both sides of the channels 2, 4.) The holes 6 may also serve as attachment point for fixing the channels into the floor or ceiling by screws, bolts, or nails.

The panels 10 are preferably made of plywood and provide opposite face 11—11. Other materials, such as sheet metal, are also usable. If plywood is used, it may be painted or covered with another materials such as plastic sheeting for the sake of appearance. Each panel 10 is provided with an inner pivot edge 10*a* to which is fastened an upright support or stiffening member 12 which serves as a stiffener and brace for the panel. The upright members are preferably steel angle stock. The remainder of the panel periphery comprises a swingable front edge 10*b* and opposed top and bottom edges 10*c*, 10*d*.

Steel tabs 14 are welded to the upright 12 at intervals. Each tab 14 has a hole 16 at the protruding end to accept a screw or other fastener 17 for attaching the tab the plywood. These tabs are needed with plywood especially, because screws fastened near the edge of a sheet of plywood are prone to pull out. The tabs place the attachment screws farther into the plywood.

At the upper end of the member 12 is a horizontal top support member 18 which may be made of the same material as is the upright 12. This member also has tabs 14. The member 18 extends to substantially half the width of the panel 10 and acts in concert with the vertical member 12 to support the weight of the panel. To form the joint, the member 18 and the upright 12 may both be cut at 45 degrees during assembly and butt welded together as at 19.

At either end of the upright 12 is a steel dowel 20 which is welded to the upright 12, so that the dowels vertically protrude from the two ends. The dowels 20 are inserted into the holes 6 in the channels 2, 4 to form the hinge about which the panel 19 rotates.

A washer 22 may be disposed beneath the upright member 12 to distribute the weight of the panel 10 and items stored on the panel, and prevent binding. A simple washer is preferable to a more costly bearing, because a certain amount of friction is useful in the pivot. Ball bearings or the like, which would allow rotation under small torques, would also lead to unwanted motions of the panels, and make difficult the retrieval of items.

The sides of the panels 10 are covered with various surfaces adapted to store a wide variety of items. These surfaces might include, among others, the following shown in FIG. 1: pegboard 30 (shown with hooks 32), wire mesh 34, bins 36, and racks 38.

Wire mesh is useful for storing large irregular objects; these are usually difficult to store in containers, but may be easily tied to the mesh 34. The mesh may be of the type having numerous small diamond-shaped openings, which is made by making parallel cuts in a sheet of metal and then pulling the ends of the sheet to open the cuts.

The pegboard 30 contains rows and columns of drilled holes 31. It is used in conjunction with a variety of hangers made of heavy bent wire.

To use space efficiently, the panels should extend from floor to ceiling. Thus, in a typical room, proprietary 8-footlong plywood sheets may be used for panels. Since the upper reaches of the plywood panel will then be above eye level, the top few feet or upper portion of the panels are set aside for pegboard, mesh, or other open storage means which do not require looking down to ascertain the items stored. The lower region or portion of the panel may have bins, racks, or the like, as a user will then be able to look down into the contents thereof.

In a storage system like that of the instant invention, in which a wide variety of items may be stored, a filing system is awkward to institute to several reasons. First, a system such as the prsent one may be used in a small and informal place such as a laboratory, workshop, or garage where there is no fil ing system and no clerk to institute such a system; second, the type of items used may frequently change; third, it is difficult to categorize items of many different sorts because a sophisticated filing system is needed.

In view of the above, the panels of the present invention are so arranged that items mounted upon the panel surfaces or in bins or racks on the surfaces may be visible from outside. That is, the panels are spaced so that sufficient free space remains between any two adjacent panels to allow looking into the space, without necessarily allowing a person to walk into the space. Said differently, the spacing allows visual access to the items without allowing physical access (or only limited physical access) to the items. In the case of full-sized panels, such a panels made of 4-foot by 8-foot plywood sheets, the spacing would be such as to allow some reaching within, but not actual entry of the body as a whole, into the space between the panels. One foot between items, hooks or racks of adjoining panels would be a typical dimension.

A user may thus visually browse and easily find the item desired without laboriously moving each panel; the found item may then be reached by moving the appropriate panel or panels. This would be impossible if the panels were very closely adjoining; then each panel would need to be laboriously moved.

The present invention thus minimizes floor space but does not require a filing system.

It is to be understood that the present invention is not limited to the sole embodiment described above, but encompasses any and all embodiments within the scope of the following claims.

I claim:

1. A storage system comprising;

elongated horizontally disposed top and bottom channels, said top channel adapted to be affixed adjacent a ceiling and said bottom channel adapted to be affixed adjacent a floor, a plurality of substantially rectangular panels having opposite faces and disposed between said top and bottom channels, each said panel having a front swingable edge and an opposed rear pivot edge, said swingable and pivot edges bounded by opposed top and bottom edges, a vertical elongated stiffening member having opposite ends and fully abutting each said panel pivot edge, a first set of a plurality of individual and distinct mounting tabs on each said stiffening member, arrayed therealong from top to bottom thereof and extending toward said panel swingable edge, fastening means passing through said tabs and into said panel at a point forward of said stiffening member, a horizontal top support member abutting said panel top edge, affixed to said vertical stiffening member, and terminating well short of said panel front edge, a second set of a plurality of individual and distinct mounting tabs on each said top support member, arrayed therealong outwardly from said vertical stiffening member, between said panel rear edge and said panel front edge, and extending toward said panel bottom edge, fastening means passing through said top support member tabs and into said panel at a point downward of said top support member, pivot means respectively projecting from said stiffening member opposite ends and engageable with said top and bottom channels, disparate article engagement and containment means attached to at least one said face of at least selected ones of said plurality of panels and projecting from the plane of said panel faces, said engagement means attached to said panel face in an area immediately below said top support member and adapted to support articles hung therefrom, said containment means comprising open-top means attached to said panel face in an area immediately above said panel bottom edge and adapted to serve as a depository for articles placed therewithin, and said pivot means of said panels engaging said channels to mount said panels to provide a space between adjacent said panels that accommodates said engagement and containment means but precludes a person's body from entering therebetween when adjacent ones of said panels are substantially parallel one another, whereby, a person standing adjacent said panel front edges has visual access to articles hung on said engagement means and which are at or above eye level while by looking downwardly into said containment means, visual access is had to articles disposed therewithin.

2. A storage system according to claim 1 wherein, said panel faces include a pegboard.

3. A storage system according to claim 1 wherein, said engagement means includes a plurality of removable hook elements.

4. A storage system according to claim 1 wherein, said containment means includes bins.

5. A storage system according to claim 1 including, a further panel comprising a framed body of expanded metal whereby, a plurality of openings are provided and which allow for the hanging of articles therefrom.

* * * * *